US011782364B2

(12) United States Patent
Oi

(10) Patent No.: US 11,782,364 B2
(45) Date of Patent: Oct. 10, 2023

(54) IMAGE FORMING APPARATUS WITH HEAT FIXING DEVICE POWERED BY BIDIRECTIONAL THYRISTOR

(71) Applicant: CANON KABUSHIKI KAISHA, Tokyo (JP)

(72) Inventor: Ken Oi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/405,799

(22) Filed: Aug. 18, 2021

(65) Prior Publication Data

US 2022/0082966 A1 Mar. 17, 2022

(30) Foreign Application Priority Data

Sep. 14, 2020 (JP) ..... 2020-153952

(51) Int. Cl.
*G03G 15/20* (2006.01)
*G03G 15/00* (2006.01)

(52) U.S. Cl.
CPC ..... *G03G 15/2017* (2013.01); *G03G 15/2039* (2013.01); *G03G 15/5004* (2013.01); *G03G 15/5045* (2013.01)

(58) Field of Classification Search
CPC ..... G03G 15/2017; G03G 15/2039; G03G 15/5004; G03G 15/5045
See application file for complete search history.

(56) References Cited

U.S. PATENT DOCUMENTS 3,932,770 A 1/1976 Fantozzi ..... 307/117
6,984,810 B2 1/2006 Ishii ..... 219/492
8,600,259 B2 12/2013 Oi et al. ..... 399/90
9,069,301 B2 6/2015 Oi ..... G03G 15/2039
10,928,759 B2 2/2021 Oi et al. ..... G03G 15/2042
(Continued)

FOREIGN PATENT DOCUMENTS

JP S62-123955 6/1987
JP 2004-146366 5/2004
JP 2014-167542 9/2014

OTHER PUBLICATIONS

Yasunobu Arita, Satoshi Mori, & Yoshiharu Yu (Feb. 1985) "Power 20 Control Circuit Design Know-how", CQ Publishing Co., Ltd., p. 57.

(Continued)

*Primary Examiner* — Stephanie E Bloss
*Assistant Examiner* — Michael A Harrison
(74) *Attorney, Agent, or Firm* — Venable LLP

(57) ABSTRACT

An image forming apparatus includes a fixing unit including a heater; a bidirectional thyristor for supplying electric power form an AC power source to the heater in a conduction state and for cutting off supply of the electric power from the AC power source to the heater in a non-conduction state; a control unit for outputting a control signal for controlling the conductive state or the non-conduction state of the bidirectional thyristor; and a DC voltage source for supplying electric power for conduction of the bidirectional thyristor by the control signal outputted from the control unit. The control unit controls the heater in a predetermined control cycle on a one half-wave unit basis of an AC voltage of the AC power source. The control unit outputs a plurality of control signals in one half-wave of the AC voltage.

12 Claims, 8 Drawing Sheets

(56) References Cited

U.S. PATENT DOCUMENTS

| | | | | |
|---|---|---|---|---|
| 2004/0129694 | A1 | 7/2004 | Ishii | 219/492 |
| 2013/0114969 | A1* | 5/2013 | Wakide | H02J 3/10 399/88 |
| 2013/0266333 | A1* | 10/2013 | Fujiwara | H05B 1/0241 219/494 |

OTHER PUBLICATIONS

Yasunobu Arita, Satoshi Mori, & Yoshiharu Yu (Feb. 1985) "Power 20 Control Circuit Design Know-how", CQ Publishing Co., Ltd., pp. 56-59.

* cited by examiner (a)

(b)

(c)

IMAGE FORMING APPARATUS WITH HEAT FIXING DEVICE POWERED BY BIDIRECTIONAL THYRISTOR

FIELD OF THE INVENTION AND RELATED ART

The present invention relates to an image forming apparatus and particularly relates to electric power control of a fixing device used in the image forming apparatus.

Conventionally, an image forming apparatus such as a copying machine or a printer, i.e., an image forming apparatus in which a toner image formed on a recording material with toner comprised of a heat-softening resin material or the like by an image forming process unit of an electrophotographic type or the like exists. In the image forming apparatus, a heat-fixing device for heat-processing the toner image is used. The heat-fixing device includes a heater which generates heat by electric power supplied from an AC power source, and in control of electric power to the heater, a bidirectional thyristor (hereinafter, referred to as a triac) is used in general. As a general driving unit for the triac, there is a drive constitution in which for example, when a T1 terminal of the triac is set at a reference potential, both a T2 terminal and a gate terminal are set at positive (+) potentials (trigger mode I) or negative (−) potentials (trigger mode III) (Yasunobu Arita, Satoshi Mori, & Yoshiharu Yu (February 1985) "Power Control Circuit Design Know-how", CQ Publishing Co., Ltd., p. 57).

As shown in part (a) of FIG. 8, there is a circuit constitution in which a potential difference of an AC power source 804 is used as a power source of a gate trigger signal of a triac 801. In this case, the triac 801 at a zero-cross point of the AC power source 804 cannot start conduction. With a larger potential difference between the T1 terminal and the T2 terminal at the time of a start of the conduction of the triac 801, an amount of switching noise generated increases, and therefore, a large noise filter 805 is required for suppressing discharge of the noise to an outside of the image forming apparatus. On the other hand, as shown in part (b) of FIG. 8, there is a circuit constitution in which a capacity (capacitative) element 901 is used as the power source of the gate trigger signal of the triac 801 (see U.S. Pat. No. 3,932,770). The capacity element 901 is charged every half cycle of the AC power source 804, and a DRV signal is in a high level state, so that the gate trigger signal is supplied from electric power accumulated in the capacity element 901, with the result that a conduction state is established between the T1 terminal and the T2 terminal (trigger mode II or III). In the constitution of part (b) of FIG. 8, it becomes possible to start the conduction of the triac 801 from the zero-cross point of the AC power source 804. In the case where control of electric power to the heat-fixing device is carried out on a half-wave basis of the AC power source 804, the triac 801 is driven in synchronism the zero-cross point of the AC power source 804. By this, the switching noise is suppressed, so that the noise filter becomes relatively small.

In general, the AC power source outputs a sine wave with a predetermined frequency. However, due to a quality of the AC power source, distortion occurs in a waveform of an AC voltage in some instances. Depending on the distortion of the waveform (hereinafter, referred to as waveform distortion), a voltage between the T1 terminal and the T2 terminal of the triac as shown in part (c) of FIG. 8 becomes 0 V in some instances at a timing different from a zero-cross point during a normal operation, so that conduct of the triac 801 stops in some instances. In part (c) of FIG. 8, an upper port represents a voltage waveform [V] of the AC power source, and a lower part represents a current waveform [A] flowing through the triac 801, in which the current waveform during the normal operation is indicated by a dotted line. When the waveform distortion continuously occurs, improper temperature rise of a fixing device can occur due to insufficient supply of electric power to a heater. As a means for suppressing the insufficient electric power supply, there is a first means for always monitoring that the AC voltage becomes 0 V, by a detecting circuit portion of a ZEROX signal. In the case where an unintended 0 V-state due to the waveform distortion is detected, a gate trigger signal is outputted again, so that a half-wave of the AC voltage which is a control object can be conducted again. Further, there is also a second means such that the gate trigger signal is continuously supplied in a half-wave period which is a control object. Even when the conduction of the triac 801 is stopped by the waveform distortion in the half-wave period which is the control object, a gate trigger current is continuously supplied, and therefore, the conduct of the triac 801 is established again.

However, in the case where the conventional first means is used, a load on a CPU with monitoring of the ZEROX signal increases, and a period in which a signal for suppressing erroneous detection of the ZEROX signal due to the noise or the like is needed, and therefore, it is difficult to always monitor the ZEROX signal. Further, in the case of the conventional second means, during the half-wave period which is the control object, electric power of the capacity element is always discharged. As a result, a power source capacitor of a triac driving circuit becomes large, and leads to increases in cost and component part size.

SUMMARY OF THE INVENTION

According to an aspect of the present invention, there is provided an image forming apparatus comprising: a fixing unit including a heater and configured to fix a toner image, formed on a recording material, by heat of the heater; a bidirectional thyristor configured to supply electric power from an AC power source to the heater in a conduction state and configured to cut off supply of the electric power from the AC power source to the heater in a non-conduction state; a control unit configured to output a control signal for controlling the conductive state or the non-conduction state of the bidirectional thyristor; and a DC voltage source configured to supply electric power for conduction of the bidirectional thyristor by the control signal outputted from the control unit, wherein the control unit controls the heater in a predetermined control cycle on a one half-wave unit basis of an AC voltage of the AC power source, and wherein the control unit outputs a plurality of control signals in one half-wave of the AC voltage.

Figure 8:
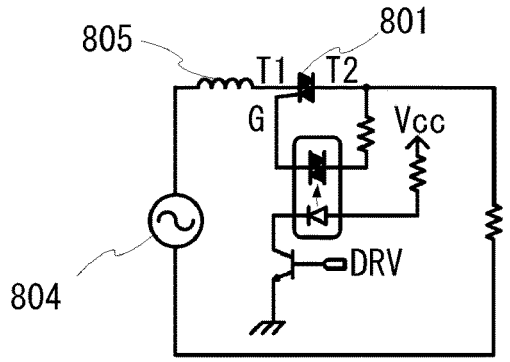
Figure 8:
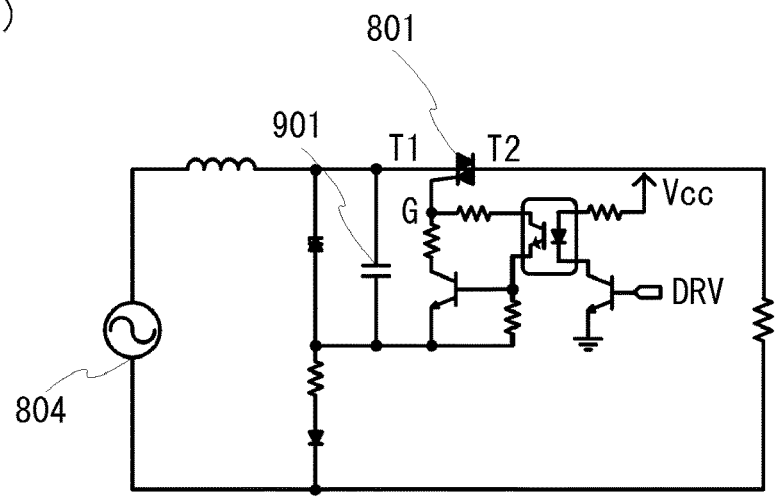
Figure 8:
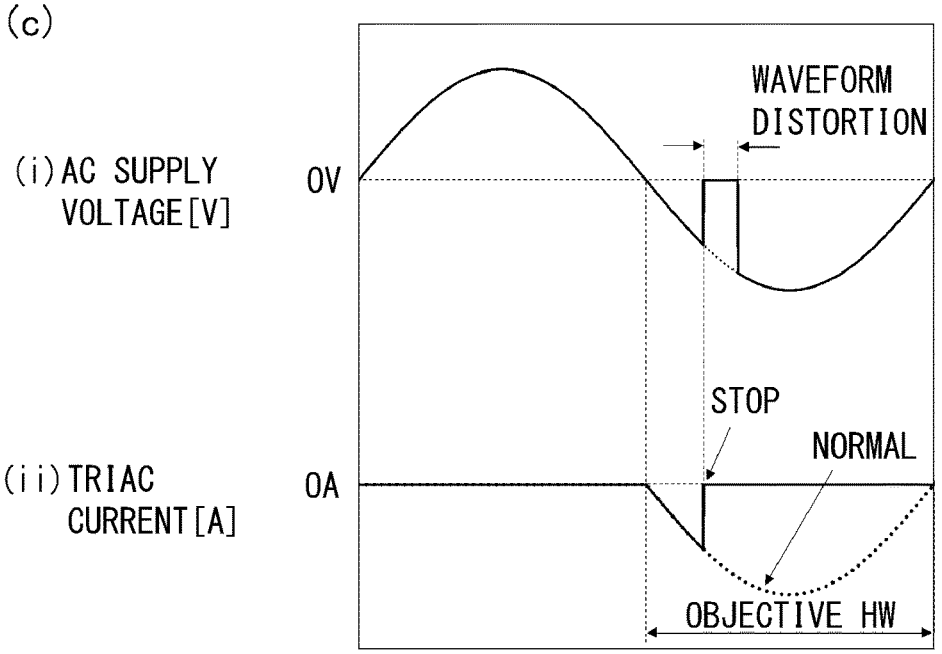

Parts (a), (b) and (c) of FIG. 8 are a schematic view showing a driving circuit in trigger modes I and III of a conventional triac, a schematic view showing a driving circuit in trigger modes II and III of the conventional triac, and a schematic view showing an example of a conduct stop of the conventional triac due to waveform distortion of an AC power source, respectively.

DESCRIPTION OF THE EMBODIMENTS

In the following, embodiments for carrying out the present invention will be described specifically with reference to the drawings. Incidentally, in the following description, a bidirectional thyristor includes a T1 terminal, a T2 terminal, and a G terminal and is capable of establishing conduction in four trigger modes. Here, when the T1 terminal is a reference terminal, a trigger mode I refers to the case where the T2 terminal is positive and the G terminal is positive, and a trigger mode II refers to the case where the T2 terminal is positive and the G terminal is negative. Further, a trigger mode III refers to the case where the T2 terminal is negative and the G terminal is negative, and a trigger mode IV refers to the case where the T2 terminal is negative and the G terminal is positive.

Embodiment 1

[Image Forming Apparatus]

Figure 1:
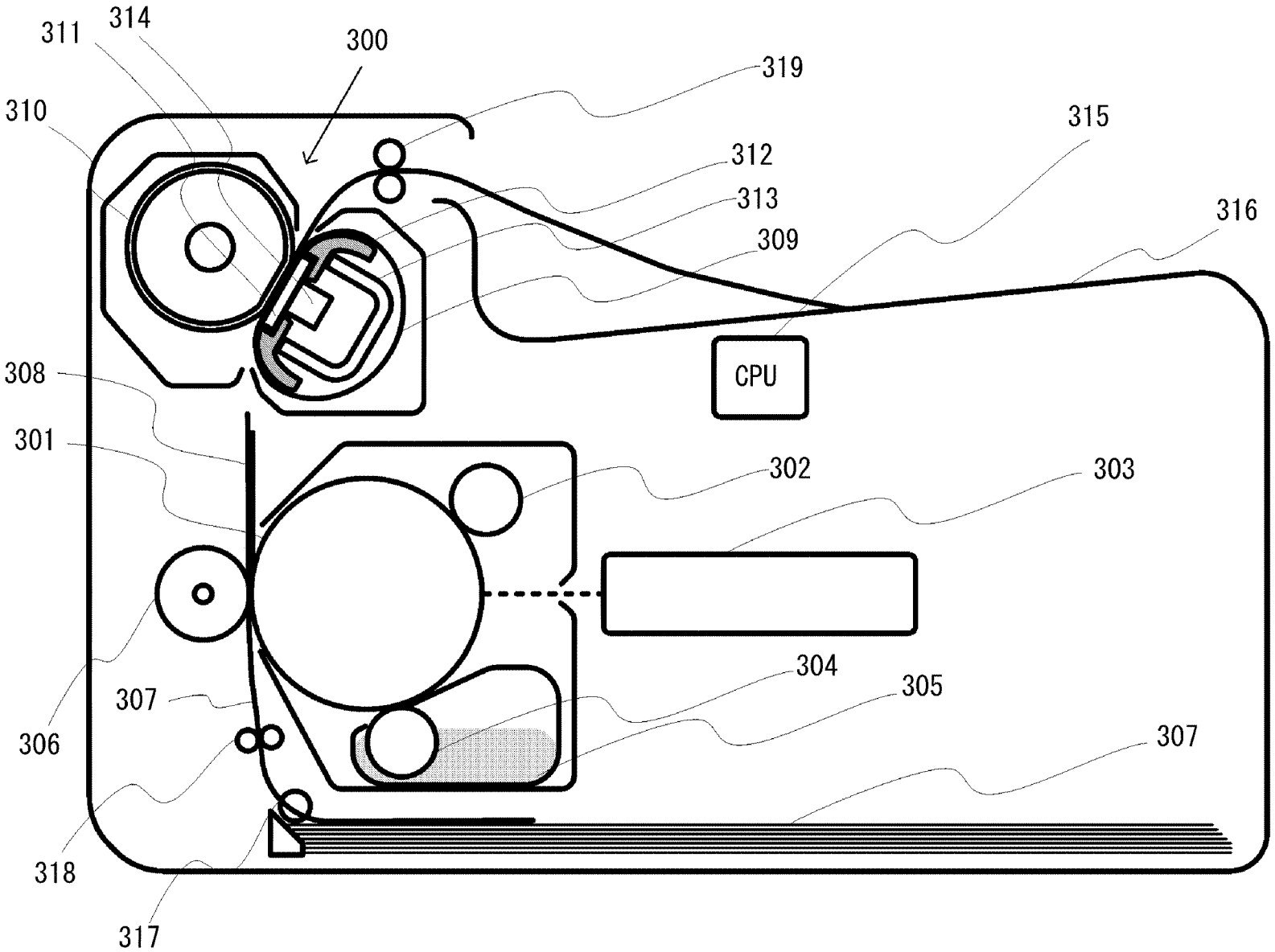
FIG. 1 is a schematic view of an image forming apparatus of an embodiment 1.

As an example of an image forming apparatus including a fixing device in an embodiment 1, a schematic view of a laser beam printer of an electrophotographic type is shown in FIG. 1. On a surface of a photosensitive drum 301 which is a photosensitive member, a photosensitive layer is formed, and the signal layer is electrically charged by a charging roller 302, and thereafter, a latent image is formed by irradiation of the signal layer with laser light from a laser scanner 303. To the latent image formed on the photosensitive drum 301, toner 305 is imparted by a developing roller 304 which is a developing unit, so that a toner image is formed on the photosensitive drum 301. A transfer roller 306 which is a transfer unit feeds a recording material 307 toward a fixing device (fixing unit) 300 while transferring the (unfixed) toner image onto the recording material 307 in a transfer nip between the photosensitive drum 301 and the transfer roller 306. The fixing device 300 includes a cylindrical fixing film 309 and a heater 311 provided in an inside space of the fixing film 309. The fixing film 309 is a film for which a depth direction of FIG. 1 is a longitudinal direction. A pressing roller 310 contacts an outer peripheral surface of the fixing film 309 and is pressed against the fixing film 309, so that a fixing nip is formed. A recording material 307 is heated while being nipped and fed in the fixing nip formed by the heater 311 and the pressing roller 310 via the fixing film 309. The heater 311 is a heater comprised of, for example, a base material made of ceramic, a heat generation layer, and a protective layer. A stay 312 holds the heater 311. A member 313 is a reinforcing member. A thermistor 314 which is a temperature detecting voltage detects a temperature of the heater 311. For example, an unfixed toner image 308 is fixed on the recording material 307 by heating of the heater 311 connected in series with an overheating protective element (not shown) comprised of a temperature fuse and with an electric power supply during portion. Thereafter, the recording material 307 is discharged from the fixing nip to a discharge portion 316 of the image forming apparatus through a discharge opening. Incidentally, a sheet feeding roller 317 is a roller for feeding the recording material 307, and conveying roller pairs 318 and 319 are roller pairs for conveying the recording material 307. A CPU 315 controls various operations of the image forming apparatus.

[Electric Power Supply Circuit]

Figure 2:
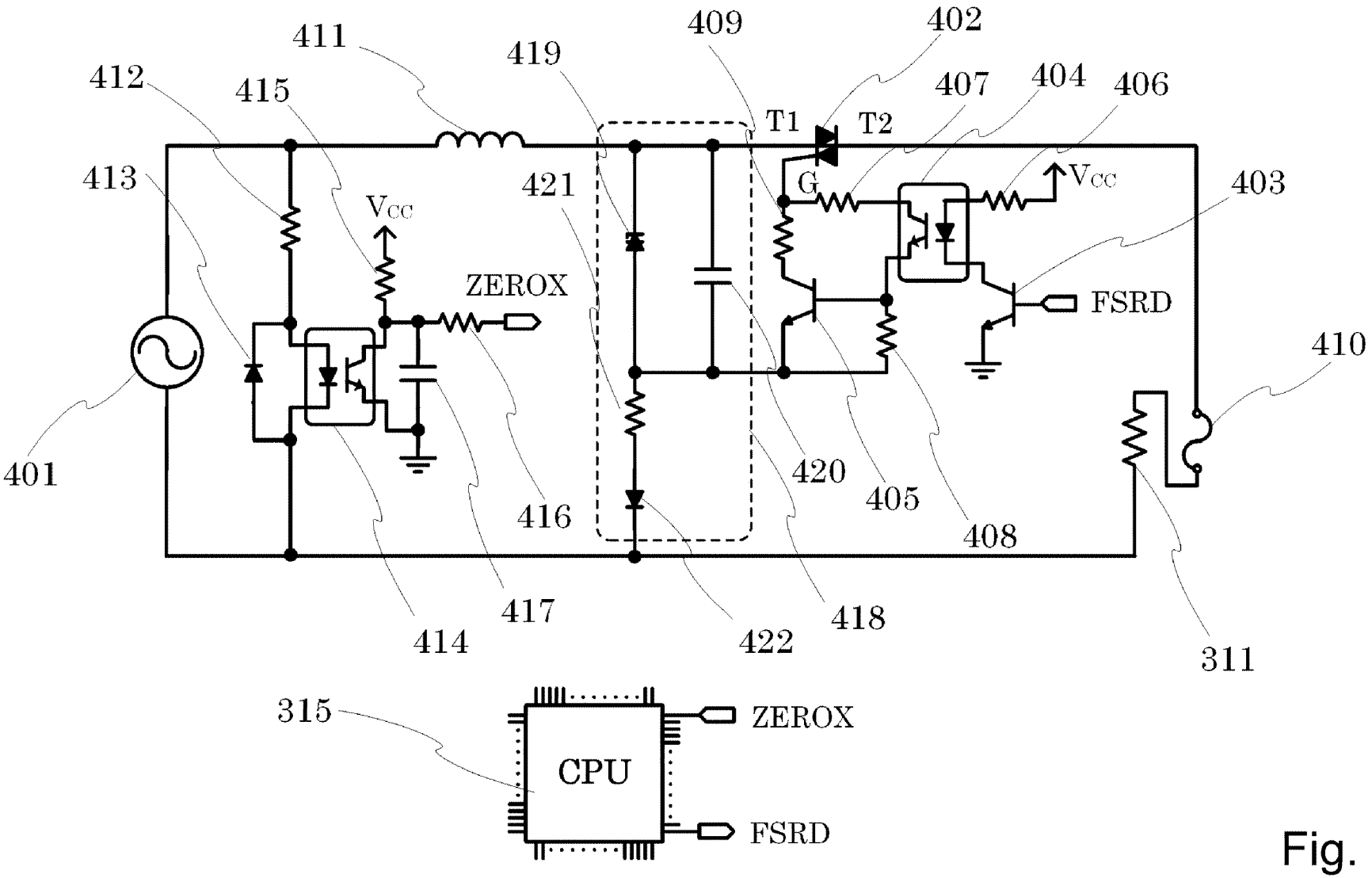
FIG. 2 is a constitutional view of a power supply circuit to a heater in the embodiment 1.

An electric connection schematic view of a circuit of electric power supplied to the heater 311 is shown in FIG. 2. Electric power supply from an AC power source 401 to the heater 311 is controlled by using a bidirectional thyristor (hereinafter, referred to as a triac) 402. The triac 402 is brought into conduction when electric power is supplied from the AC power source 401 to the heater 311, and is brought out of conduction when the supply of the electric power from the AC power source 401 to the heater 311 is cut off. A circuit for driving the triac 402 includes transistors 403 and 405, a photo-coupler 404, and registers 406, 407, 408 and 409.

The CPU 315 calculates an amount of electric power supply to the heater 311 on the basis of a temperature detection result of the thermistor 314. The CPU 315 outputs, at a high level, an FSRD signal which is a control signal, depending on a calculation result, so that the transistor 403 is brought into conduction. When the transistor 403 is brought into conduction, a current flows from a power source Vcc via the register 406, so that the photo-coupler 404 is brought into conduction and thus the transistor 405 is brought into conduction. By the conduction of the transistor 405, a gate trigger voltage is applied from a capacitor 420 to between the T1 terminal of the triac 402 and a gate terminal (hereinafter, referred to as the G terminal) of the triac 402, so that a gate trigger current flows. The gate trigger voltage applied depending on the FSRD signal is hereinafter referred to as a gate trigger signal. As a result, a conduction state is established between the T1 terminal and the T2 terminal of the triac 402, so that the electric power is supplied from the AC power source 401 to the heater 311. An overheating protective element 410 is an element for preventing overheat of the heater 311. A coil 411 suppresses discharge of switching noise, to an outside of the image forming apparatus, generating at the time of a start of the conduction of the triac 402. The CPU 315 carries out control in a predetermined control capacity on a one half-wave unit basis of an AC voltage of the AC power source 401.

The registers 412, 415 and 416, a diode 413, the photo-coupler 414, and the capacitor 417 constitute a zero-cross detecting circuit which is a zero-cross detecting unit. The zero-cross detecting circuit outputs a high-level or low-level signal (hereinafter, referred to as a ZEROX signal) to the CPU 315 depending on an AC voltage waveform of the AC power source 401. The CPU 315 determines an output timing of an FSRD signal in synchronism with the ZEROX signal based on output of the photo-coupler 414 changing depending on an instantaneous value of the voltage of the AC power source 401, i.e., on the basis of a detection result of the zero-cross detecting circuit. By this, the triac 402 is started to be brought into conduction in the neighborhood of the zero-cross point of the AC power source 401.

[Power Source 418]

Here, a power source (electric power source) 418 for the gate trigger signal will be described. The power source 418 includes Zener diode 419, a capacitor 420, a register 421, and a diode 422. In the power source 418, the T1 terminal of the triac 402 is used as a reference potential, and a DC voltage source is constituted by the Zener diode 419 and the capacitor 420. The capacitor 420 is charged every half-wave of an AC voltage waveform of the AC power source 401 via the diode 422 until an end-to-end voltage thereof reaches Zener voltage Vz (hereinafter, referred to as Vz voltage) of the Zener diode 419. In the embodiment 1, for example, an AC voltage of the AC power source 401 is 100 V AC, a frequency fac is 60 Hz, the Vz voltage is 10 V, a resistance value R409 of a register 409 is 150Ω, and a resistance value R407 of a register 407 is 4.7 kΩ. Further, a gate trigger voltage Vgt of the triac 402 in the trigger mode I or III is 1.5 V, and a maximum gate trigger current Igt_max of the triac 402 in the trigger mode I or III is 50 mA. Then, when the triac 402 is driven, the capacitor 420 is required to supply a potential difference exceeding the gate trigger voltage Vgt (for example, 1.5 V) and a current exceeding the maximum gate trigger current Igt_max (for example, 50 mA). Incidentally, a mask period of a signal in zero-cross point detection in the embodiment 1 is half of one capacity of the AC power source 401.

[Gate Trigger Signal in Embodiment 1]

Figure 3:
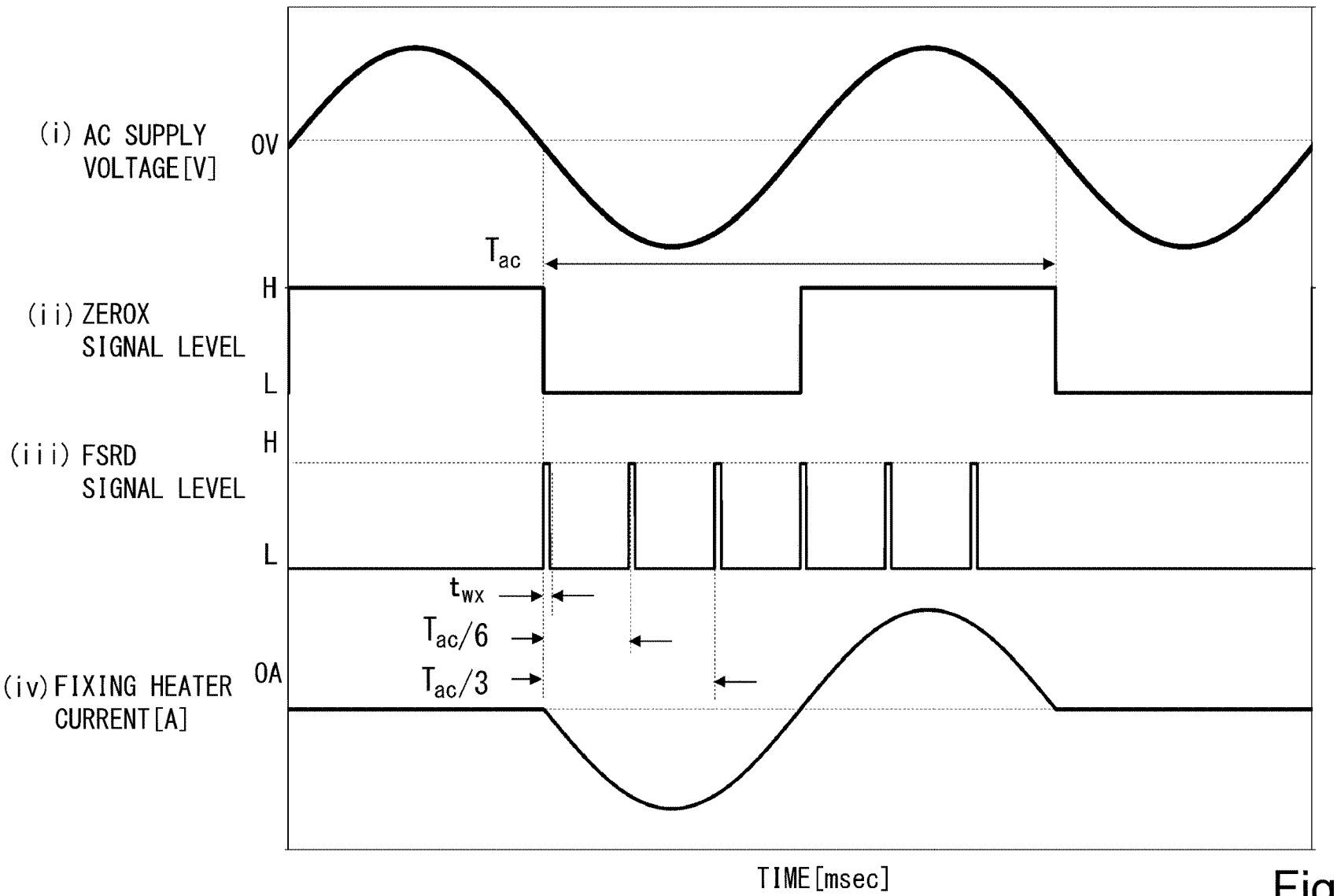
FIG. 3 is a schematic illustration when a plurality of FSRD signals are outputted in the embodiment 1.

Here, electric power supply control of the triac 402 in the embodiment 1 are shown in FIG. 3. In FIG. 3, (i) represents a waveform of a voltage (value [V] of the AC power source 401, and (ii) represents a level (high level or low level) of the ZEROX signal which is a zero-cross detection result. further, (iii) represents the FSRD signal outputted by the CPU 315, and (iv) represents a waveform of a current (heater current) flowing through the heater 311. In each of (i) to (iv), the abscissa represents a time [msec]. Incidentally, in the following description, the gate trigger signal is a signal (voltage) depending on the FSRD signal, and therefore, the FSRD signal is described by being replaced with the gate trigger signal in some cases.

The CPU 315 supplies the gate trigger signal of a time width Twx=200 μsec with a zero-cross point, as a starting point, of a half-wave of an AC voltage for bringing the triac 402 into conduction (hereinafter, referred to as a conduction object half-wave). A gate trigger signal, outputted first, with the zero-cross point as the starting point is hereinafter referred to as a first gate trigger signal. The CPU 315 further outputs the gate trigger signal twice in the conduction object half-wave (one half-wave) at an interval of, for example, ⅙ of one capacity (hereinafter, referred to as an AC power source capacity), Tac (=1/fc) of the AC power source 401. That is, the CPU 315 supplies the gate trigger signal three times in total in a half-wave which is an object of the same electric power supply (hereinafter, referred to as the same power supply object half-wave). Incidentally, at least one gate trigger signal outputted after the first gate trigger signal with the zero-cross point as the starting point is hereinafter referred to as other gate trigger signals. In the embodiment 1, two other gate trigger signals are outputted, so that the first gate trigger signal, and a second gate trigger signal and third gate trigger signal which are subsequent to the first gate trigger signal are outputted. Thus, the CPU 315 determines an output interval of these three gate trigger signal depending on a frequency fac of the AC power source 401 based on the zero-cross detection result. For this reason, even when the frequency fac of the AC power source 401 changes, the CPU 315 is capable of supplying the gate trigger signal at a timing which is obtained by dividing the half-wave of the electric power supply into three equal parts. Thus, the CPU 315 outputs a plurality of control signals at timings depending on the frequency of the AC power source 401 in one half-wave of the AC voltage.

Figure 4:
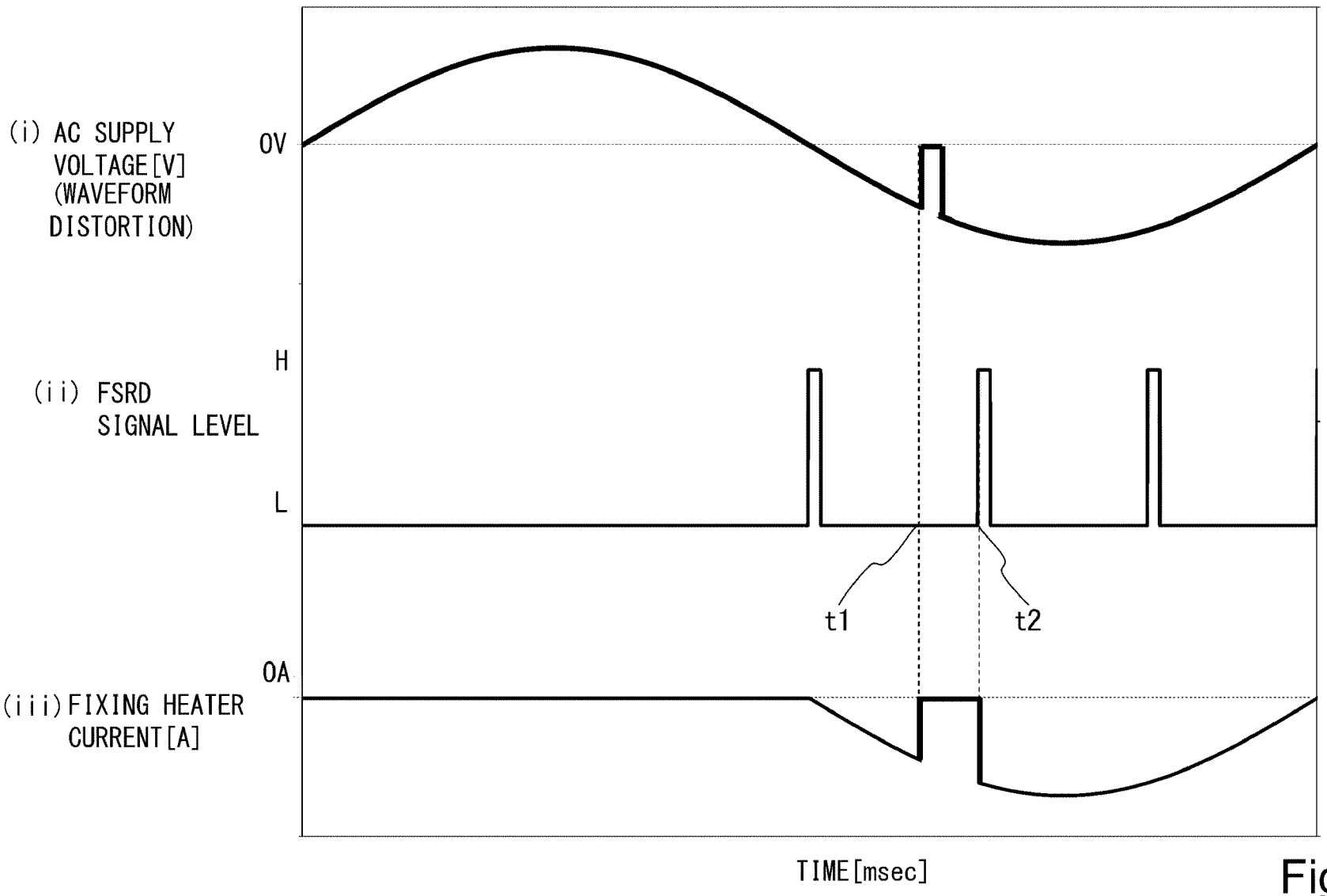
FIG. 4 is a schematic illustration when the plurality of FSRD signals are outputted in the case where waveform distortion occurs in the embodiment 1.

Further, an output timing of the first gate trigger signal with respect to the same power supply object half-wave is such that the first gate trigger signal is outputted in conformity to the zero-cross point of the AC power source 401 on the basis of the ZEROX signal which is the zero-cross detection result. Here, FIG. 4 shows respective waveforms in the case where waveform distortion occurs in the AC power source 401, in which (i) represents a waveform of a voltage value [V] of the AC power source 401, and (ii) represents a gate trigger signal (or FSRD signal) outputted by the CPU 315. Further, (iii) represents a waveform of a current flowing through the heater 311. In each of (i) to (iii), the abscissa represents a time [msec]. By carrying out the supply of the gate trigger signal as described above, the following effect can be obtained. That is, even in the case where the power supply object half-wave is turned off by the waveform distortion occurring at a timing t1 as shown in FIG. 4, the triac 402 can be brought into conduction again by the subsequent gate trigger signal, i.e., by the second gate trigger signal at a timing T2 in the case of FIG. 4. By this, improper temperature rise of the fixing device 300 can be suppressed. Thus, the CPU 315 outputs a plurality of FSRD signals in one half-wave of the AC voltage.

[Capacity of Capacitor 420]

A capacitor of the capacitor 420 necessary when such electric power supply control is carried out will be described. At a point of the time of a start of the electric power supply in the power supply object half-wave, in the case where an end-to-end potential difference Vc of the capacitor 420 is charged to the Vz voltage, a relationship of the gate trigger current Igt at a time t from the start of the electric power supply can be approximated as shown in the following formula (1).

$$I_{gt}(t)=V_Z\cdot e^{-t/C_{420}R_{409}}/R_{409} \quad (1)$$

In the formula (1), a saturated voltage of the transistor 405, i.e., the gate trigger voltage Vgt is omitted.

Here, a high-level time of one gate trigger signal (which is also a time width (duration) of the gate trigger signal) is twx, for example, 200 μsec. A gate trigger signal supply period (total supply time) tgt per (one) electric power supply half-wave is {(time width tgt)=200 μsec}×3. For this reason, from the formula (1), a capacity $C_{420}$ of the capacitor 420 satisfying the gate trigger current Igt (0.6 msec)>Igt_min, flowing in one electric power supply half-wave becomes 14 g or more. The capacity of the capacitor 420 is determined on the basis of a value of a sum of currents flowing through between the T1 terminal and the gate terminal of the triac 402 when the plurality of gate trigger signals are outputted. The capacitor 420 is charged only every half-wave of the AC power source 401, and therefore, the capacitor $C_{420}$ may preferably be a capacitor of 28 g or more which is twice the above-described 14 μF or more. On the other hand, as described in the background art, in the case where the gate trigger signal is continuously supplied during a period of the power supply object half-wave, the supply period tgt is about 8.67 msec which is the half-wave period of the AC power source 401, and the capacity $C_{420}$ necessary for the capacitor 420 is 200 g or more.

Thus, in the electric power supply control of the triac 402 in the embodiment 1, a DC power source portion based on the T1 terminal of the triac 402 is a power source of the gate trigger signal. Further, in such an electric power supply control circuit, by supplying a plurality of gate trigger signals to the same power supply object half-wave, improper temperature rise of the fixing device due to the waveform distortion occurring in the AC power source 401 can be suppressed while restricting an increase in size of the DC power source portion.

Incidentally, the number of supply of the gate trigger signals in the same power supply object half-wave in the embodiment 1 is three as an example. However, a similar effect can be obtained when the supply number is two times or more, i.e., plural times. Further, an interval of the plurality of gate trigger signals supplied in the same power supply object half-wave is an interval depending on a frequency of the AC power source 401, but the output timing may be fixed or non-fixed output timing. Further, in the embodiment 1, the constitution in the case where the trigger modes II and III of the triac 402 were used was described. However, the present invention is also applicable to the case where the trigger mode I or IV in which the T1 terminal side of the capacitor 420 is the negative potential and the G terminal side of the capacitor 420 is the positive side is used, and achieves the similar effect.

As described above, according to the embodiment 1, the improper temperature rise of the fixing device due to the waveform distortion of the AC voltage while suppressing the increase in size of the power source capacity of the circuit for dividing the bidirectional thyristor.

Embodiment 2

[Gate Trigger Signal]

A difference of a constitution of an embodiment 2 from the constitution of the embodiment 1 will be described, and a common point will be omitted from description. In the embodiment 1, by determining the output timing of the FSRD signals on the basis of the ZEROX signal by the CPU 315, the triac 402 is brought into conduction in the neighborhood of the zero-cross point of the AC power source 401. However, due to a mass-production deviation or the like of the photo-coupler 414 and the register 412 which are used for generating the ZEROX signal, a deviation can occur between output timings of a true zero-cross point and the FSRD signal of the AC power source 401 can occur. Even in the case where due to such a deviation, the FSRD signal is outputted at a high level before the true zero-cross point, in order to reliably supply the electric power in the power supply object half-wave, the following is preferred. That is, a duration Tw1 of the first gate trigger signal (corresponding to a first control signal) for the power supply object half-wave may preferably be determined in the following manner. The duration Tw1 may preferably be longer than a sum of a pulse width tw_min (required time) of the gate trigger current necessary to hold (maintain) the conduction state of the triac 402 and a deviation time gap (tw1>tw_min+tgap).

On the other hand, other gate trigger signals (corresponding to other control signals excluding the first control signal) other than the first gate trigger signal for the same power supply object half-wave is supplied in a period in which the potential difference generates between the T1 terminal and the T2 terminal. A duration twy of each of other gate trigger signals may only be required to be longer than the pulse width tw_min of the gate trigger current (twy>Tw_min). For that reason, these values may only be required to satisfy the following relationship of a formula (2).

$$t_{w1} \geq t_{gap} + t_{w_min} > t_{wy} \geq t_{w_min} \quad (2)$$

Here, in the case where the deviation time tgap is 100 pec and the pulse width tw_min of the gate trigger current is 50 pec, the duration tw1 of the gate trigger signal is set at 200 pec and the duration twy of each of other gate trigger signals is set at 100 pec. By this, the relationship of the formula (2) can be satisfied, so that the sum of the supply times (durations) for the same power supply object half-wave becomes 400 pec.

The capacity $C_{420}$ (Igt (0.4 msec)>Igt_min) of the capacitor 420 required that the current in the third gate trigger signal exceeds Igt_min on the basis of the formula (1) becomes about 10 g. The capacitor 420 is charged only every half-wave of the AC power source 401, and therefore, a preferred capacity as the capacity $C_{420}$ is about 20 g, so that it is possible to suppress the improper temperature rise of the fixing device due to the waveform distortion of the AC power source 401 in the control circuit constitution of electric power supply using a power source smaller than the power source in the embodiment 1.

Figure 5:
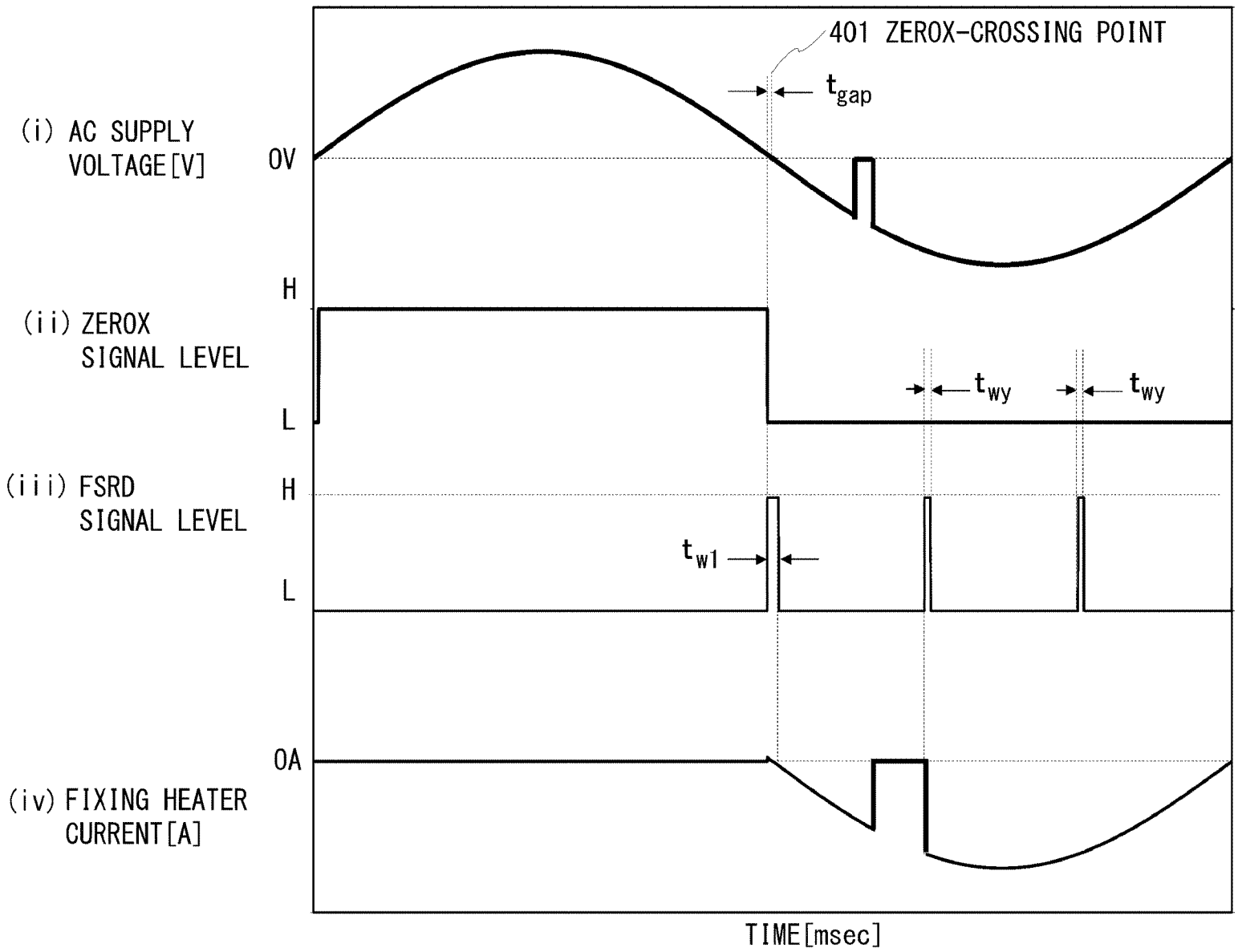
FIG. 5 is a schematic illustration when a plurality of FSRD signals are outputted in the case waveform distortion occurs in an embodiment 2.

FIG. 5 is a schematic view showing control in the embodiment 2. In FIG. 5, (i) represents a waveform of a voltage (value [V] of the AC power source 401, and (ii) represents a level (high level or low level) of the ZEROX signal which is a zero-cross detection result. further, (iii) represents the FSRD signal outputted by the CPU 315, and (iv) represents a waveform of a current (heater current) flowing through the heater 311. In each of (i) to (iv), the abscissa represents a time [msec]. As shown in (i) of FIG. 5, in the embodiment 2, the deviation time tgap occurs. Further, the waveform distortion occurs in the AC power source 401. However, even when the power supply object half-wave is turned off by the waveform distortion, by the subsequent another signal (second signal), the triac 402 can be brought into conduction again, so that the improper temperature rise of the fixing device can be suppressed.

Thus, also in the electric power supply control of the triac 402 in the embodiment 2, the electric power supply control circuit in which a DC power source portion based on the T1 terminal of the triac 402 is a power source of the gate trigger signal is used. Further, the supply periods of the first gate trigger signal and other gate trigger signals in the power supply object half-wave are changed the supply period of the first gate trigger signal and other gate trigger signals in the power supply object half-wave are changed while supplying the plurality of gate trigger signals in the same power supply object half-wave. By this, it is possible to suppress the improper temperature rise of the fixing device due to the waveform distortion while restricting the increase in size of the DC power source portion.

As described above, according to the embodiment 2, the improper temperature rise of the fixing device due to the waveform distortion of the AC voltage while suppressing the increase in size of the power source capacity of the circuit for dividing the bidirectional thyristor.

Embodiment 3

In the embodiments 1 and 2, the control in which when the conduction of the triac 402 is stopped due to the waveform distortion of the AC power source 401 in the middle of the power supply object half-wave, the conduction of the triac 402 is always resumed is carried out. On the other hand, in a situation such that the waveform distortion occurs intermittently, a ratio of insufficient electric power is different depending on an amount of electric power required per unit time by the heater 311. Incidentally, the unit time corresponds to, for example, a half-wave unit in which two half-waves (one full wave) of the AC power source 401 is a minimum. The case where a control unit of electric power supply to the heater 311 is, for example, 10 half-waves of the AC power source 401 will be described. In an embodiment 3, the CPU 315 determines whether or not a plurality of FSRD signals are outputted depending on determined electric power.

At the time a start of rise of a temperature of the fixing device 300, there is a tendency that control of continuously supplying electric power to the heater 311 is carried out, so that an electric power supply ratio in the electric power supply control unit becomes 100%. In the control by which the electric power supply ratio becomes 100%, for example, in the case where the electric power supply corresponding to one half-wave is stopped due to the waveform distortion, inputted electric power is 90%. On the other hand, the electric power supply ratio of the electric power supplied to the heater 311 when maintenance of the temperature of the fixing device 300 is principally intended lowers, so that the electric power supply ratio becomes, for example, about 30% (corresponding to 3 half-waves). For this reason, the electric power inputted in the case where the electric power supply corresponding to one half-wave is stopped due to the waveform distortion becomes 67%, and leads to an increase in temperature ripple of the fixing device 300. When such control with a low electric power supply ratio is carried out, it is possible to suppress the increase in temperature ripple of the fixing device 300 by supplying the plurality of gate trigger signals in the same power supply object half-wave.

[Electric Power Supply Control]

Figure 6:
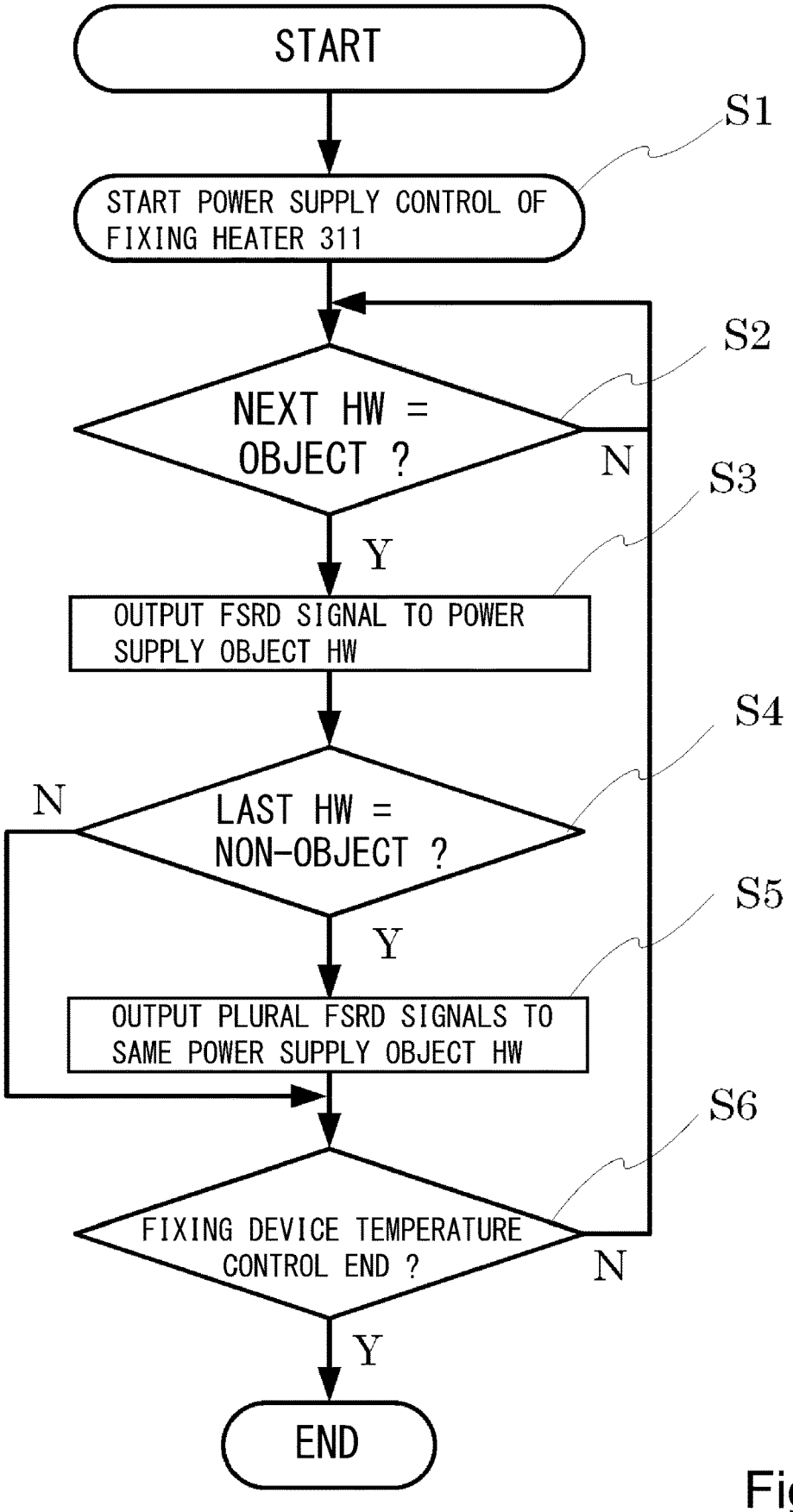
FIG. 6 is a flow chart showing an output process of a plurality of FSRD signals in an embodiment 3.

In FIG. 6, a flow chart of control of supplying the plurality of gate trigger signals in the case where the electric power supply ratio is, for example, 50% or less is shown. The CPU 315 executes processes of a step (hereinafter, referred to as S) 1 and later when temperature control of the fixing device 300 is started. In S1, the CPU 315 starts control of electric power supply to the heater 311 on the basis of a detection result of the thermistor 314. in S2, the CPU 315 discriminates whether or not a subsequent half-wave of the AC power source 401 is an electric power supply object. Here, the subsequent half-wave refers to a predetermined half-wave which is an object of the control in a predetermined control period (for example, 10 half-waves). In S2, in the case where the CPU 315 discriminated that the subsequent half-wave is not the electric power supply object, the CPU 315 returns the process to S2, and in the case where the CPU 315 discriminated that the subsequent half-wave is the electric power supply object, the CPU 315 advances the process to S3.

In S3, the CPU 315 outputs the FSRD signal and supplies the first gate trigger signal to the triac 402. In S4, the CPU 315 discriminates whether or not a current half-wave is not the electric power supply object (hereinafter, referred to as a non-electric power supply object). In S4, in the case where the CPU 315 discriminated that the current half-wave is the electric power supply object, the CPU 315 advances the process to S6, and in the case where the CPU 315 discriminated that the current half-wave is the non-electric power supply object, the CPU 315 advances the process to S5. In S5, the CPU 315 outputs a plurality of FSRD signals in the same power supply object half-wave. Incidentally, the plurality of FSRD signals are outputted at the time interval described in the embodiments 1 and 2. In S6, the CPU 315 discriminates whether or not the temperature control of the fixing device 300 is ended. In S6, in the case where the CPU 315 discriminated that the temperature control is continued, the CPU 315 returns the process to S2, and in the case where the CPU 315 discriminated that the temperature control is ended, the CPU 315 ends a series of the processes.

Figure 7:
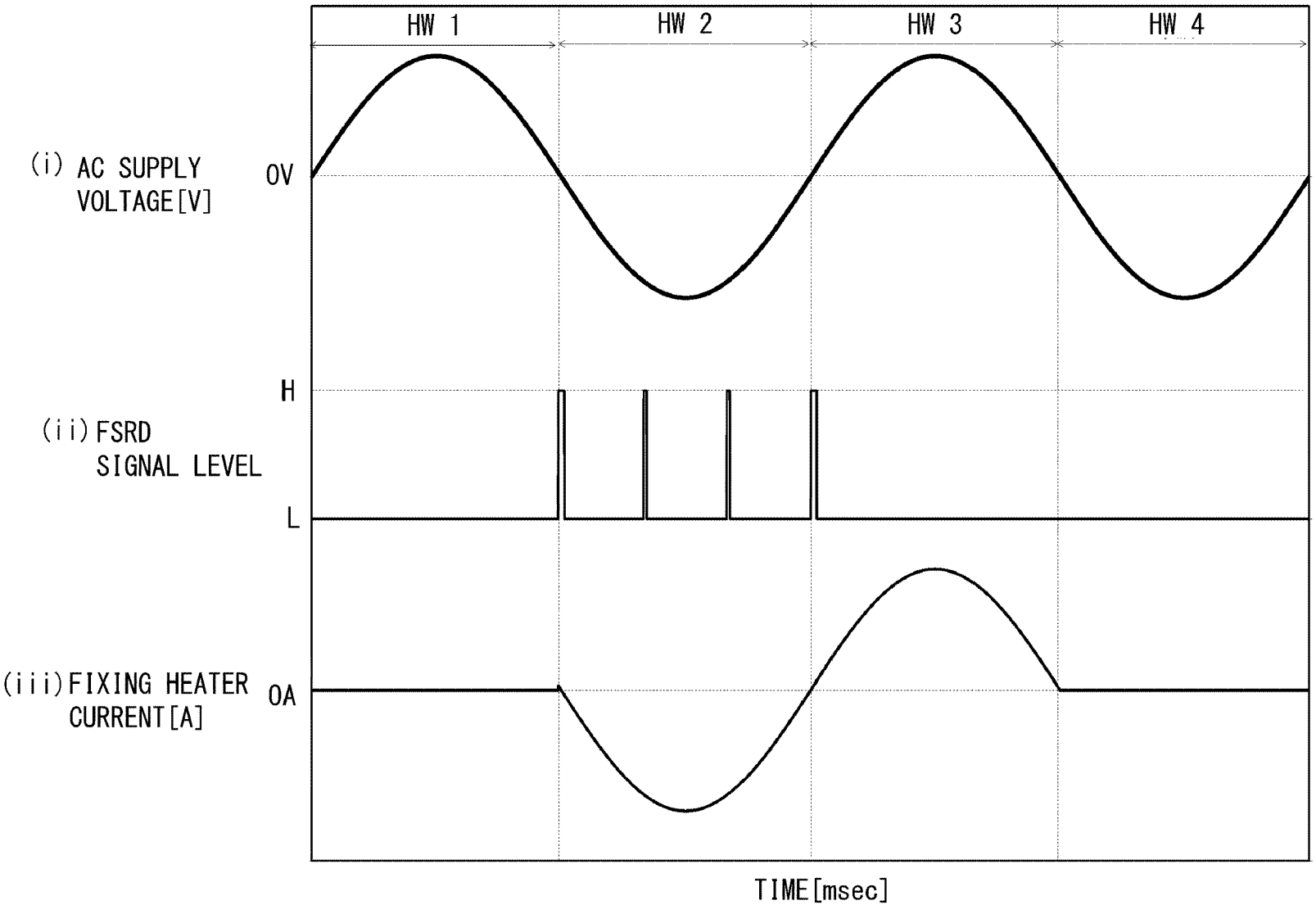
FIG. 7 is a schematic view showing an example of supply of FSRD signals when electric power control in the embodiment 3 is carried out.

In FIG. 7, an example (from half-wave 1 to half-wave 4) of a supply state of the gate trigger signal in the electric power supply control of the heater 311 to which the control in the embodiment 3 is applied is shown. In FIG. 7, (i) represents a waveform of a voltage (value [V] of the AC power source 401, (ii) represents the FSRD signal outputted by the CPU 315, and (iii) represents a waveform of a current flowing through the heater 311. In each of (i) to (iv), the abscissa represents a time [msec]. Here, the half-wave 1 and the half-wave 4 are non-electric power supply object half-waves, and the half-wave 2 and the half-wave 3 are electric power supply object half-waves. For this reason, in each of the half-wave 2 and the half-wave 3, the first gate trigger signal is supplied in the neighborhood of the zero-cross point of the AC power source 401. In the case of the half-wave 2, the half-wave 1 which is the current half-wave is the non-electric power supply object half-wave, and therefore, discrimination of S4 of FIG. 6 is "Y", so that the gate trigger signal is supplied twice in the middle of the half-wave 2.

On the other hand, in the case of the half-wave 3, the half-wave 2 which is the current half-wave is the electric power supply object half-wave, and therefore, the discrimination of S4 to FIG. 6 is "N", so that in the half-wave 3, only the first gate trigger signal for starting the conduction of the triac 402 is supplied and other signals are not supplied. That is, the process of S4 is not executed. Thus, by carrying out the control in the embodiment 3, it becomes possible to supply the plurality of gate trigger signals only in the case where the power supply ratio is 50% or less. As a result, a stop of the conduction of the triac 402 due to intermittently occurring waveform distortion is suppressed by ½ of the capacity of the capacitor 420 required per electric power supply unit, so that a degree of the temperature ripple of the fixing device 300 can be reduced.

In the embodiment 3, a DC power source portion based on the T1 terminal of the triac 402 is a power source of the gate trigger signal. In such an electric power supply control circuit, by changing the number of the plurality of gate trigger signals supplied to the same power supply object half-wave, depending on the electric power supply ratio, the temperature ripple of the fixing device due to the waveform distortion can be suppressed while restricting an increase in size of the DC power source portion. Incidentally, in the embodiment 3, the number of the gate trigger signals supplied in the subsequent half-wave was changed depending on the electric power supply state of the current half-wave. However, the number of gate trigger signals may also be changed depending on a result of the electric power supply ratio in the unit of the electric power supply control by the CPU 315. Further, the number of the single gate trigger signal or the plurality of gate trigger signals is changed depending on the electric power supply state of the current half-wave, but the number of the plurality of gate trigger signals may also be changed depending on continuous electric power supply object half-waves.

As described above, according to the embodiment 3, the improper temperature rise of the fixing device due to the waveform distortion of the AC voltage while suppressing the increase in size of the power source capacity of the circuit for dividing the bidirectional thyristor.

Other Embodiments

Embodiment(s) of the present invention can also be realized by a computer of a system or apparatus that reads out and executes computer executable instructions (e.g., one or more programs) recorded on a storage medium (which may also be referred to more fully as a "non-transitory computer-readable storage medium") to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disk (DVD), or Blu-ray Disk (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-153952 filed on Sep. 14, 2020, which is hereby incorporated by reference herein in its entirety.

What is claimed is:

1. An image forming apparatus comprising:

a fixing unit including a heater and configured to fix a toner image, formed on a recording material, by heat of said heater;

a bidirectional thyristor configured to supply electric power from an AC power source to said heater in a conduction state and configured to cut off supply of the electric power from the AC power source to said heater in a non-conduction state;

a control unit configured to output a control signal for controlling the conduction state or the non-conduction state of said bidirectional thyristor; and a DC voltage source configured to supply electric power for conduction of said bidirectional thyristor by the control signal outputted from said control unit, wherein said control unit controls said heater in a predetermined control cycle on a one half-wave unit basis of an AC voltage of the AC power source, and wherein said control unit outputs a plurality of control signals in one half-wave with a zero-cross point of the AC voltage as a starting point.

2. An image forming apparatus according to claim 1, wherein said control unit outputs the plurality of control signals at a timing depending on a frequency of the AC power source in said one half-wave of the AC voltage.

3. An image forming apparatus according to claim 1, wherein said DC voltage source includes a capacitor, and wherein a capacity of the capacitor is determined on the basis of a value of a sum of currents flowing through between a T1 terminal and a gate terminal of said bidirectional thyristor when the plurality of control signals are outputted.

4. An image forming apparatus according to claim 1, further comprising a zero-cross detecting unit configured to detect a zero-cross point of the AC voltage, wherein said control unit outputs the plurality of control signals on the basis of a detection result of said zero-cross detecting unit.

5. An image forming apparatus according to claim 1, wherein said control unit, determines a time width, in which a first control signal of the plurality of control signals is at a high level, as a time longer than a sum of a time required that said bidirectional thyristor maintains the conduction state and a deviation time between the zero-cross point and the detection result of said zero-cross point detecting unit, and determines a time width of another control signal, excluding the first control signal of the plurality of control signals, as a time width which is longer than the time required that said bidirectional thyristor maintains the conduction state and which is shorter than the time width of the first control signal.

6. An image forming apparatus according to claim 5, further comprising a temperature detecting unit configured to detect a temperature of said heater, wherein said control unit determines the electric power supplied to said heater on the basis of a detection result of said temperature detecting unit.

7. An image forming apparatus according to claim 6, in which said control unit determines whether or not the plurality of control signals are outputted depending on the determined electric power.

8. An image forming apparatus according to claim 7, wherein in a predetermined half-wave which is an object to be controlled in the predetermined control cycle, said control unit outputs only the first control signal in a case that the electric power is supplied in a half-wave before the predetermined half-wave, and outputs the plurality of control signals in a case that the electric power is not supplied in the half-wave before the predetermined half-wave.

9. An image forming apparatus according to claim 1, wherein said fixing unit includes a cylindrical film and a pressing roller contacting an outer peripheral surface of said film, wherein said heater is provided in an inside space of said film, and wherein the recording material is heated while being nipped and fed in a fixing nip formed by said heater and said pressing roller via said film.

10. An image forming apparatus according to claim 1, further comprising a driving circuit configured to drive the bidirectional thyristor, said driving circuit including a photo coupler.

11. An image forming apparatus according to claim 10, wherein said photo coupler establishes a conduction state depending on the control signal outputted from said control unit, and whereby said bidirectional thyristor establishes the conduction state by a gate trigger voltage being applied to said bidirectional thyristor.

12. An image forming apparatus according to claim 11, wherein said driving circuit includes a transistor and a resister, and wherein said transistor establishes a conduction state depending on the control signal outputted from said control unit, and said photo coupler establishes the conduction state by flowing the current from said DC voltage source through said resister when said transistor has established the conduction state.

* * * * *